United States Patent [19]

Hallström et al.

[11] 4,421,004

[45] Dec. 20, 1983

[54] METHOD AND A DEVICE FOR CAST-LOADING EXPLOSIVE CHARGES

[75] Inventors: Stig Hallström; Lars Hörman, both of Karlskoga, Sweden

[73] Assignee: Aktiebolaget Bofors, Bofors, Sweden

[21] Appl. No.: 339,589

[22] Filed: Jan. 15, 1982

[30] Foreign Application Priority Data

Jan. 19, 1981 [SE] Sweden ..... 8100253

[51] Int. Cl.[3] ..... C06D 1/08

[52] U.S. Cl. ..... 86/20 D; 86/20 V; 222/161; 264/3 R

[58] Field of Search ..... 86/1 R, 20 B, 20 D, 86/20 V, 23; 264/3 R; 425/424, 430, 431; 222/137, 161, 162

[56] References Cited

U.S. PATENT DOCUMENTS 2,195,429 4/1940 Shaler ..... 86/20 D
2,405,507 8/1946 Lefren ..... 86/23
2,897,714 8/1959 Precoul ..... 86/20 D

FOREIGN PATENT DOCUMENTS 582486 12/1924 France ..... 86/20 V
915245 1/1963 United Kingdom ..... 86/20 B

*Primary Examiner*—Leland A. Sebastian
*Attorney, Agent, or Firm*—Polloc, Vande Sande & Priddy

[57] ABSTRACT

The present invention relates to cast-loading of explosive charge compositions comprising at least two explosive components for cast-loading of a plurality of moulds or shell bodies (6) in a closed transportable unit (1). The moulds or shell bodies (6) are preheated to a predetermined temperature essentially corresponding to the melting temperature of the explosive charge composition. With the predetermined temperature substantially maintained the moulds or shell bodies (6) are filled with the liquid explosive charge composition after which a vibration movement of a specific frequency is imparted on the filled moulds or shell bodies by means of ball vibrators (24). Heavy particles of the explosive charge composition sink to the lower parts of the moulds or shell bodies. After a predetermined time period for sedimentation the filled and vibrated moulds or shell bodies are then cooled to a low temperature for solidification of the charges.

9 Claims, 7 Drawing Figures

METHOD AND A DEVICE FOR CAST-LOADING EXPLOSIVE CHARGES

TECHNICAL FIELD

The present invention relates to a method for cast-loading of explosive charges comprising at least two explosive components. The invention also relates to a device for carrying out said method.

STATE OF THE ART

Shaped charges comprising explosive components such as octogen and trotyl have previously been produced more or less by hand which means that the solid explosive components have been crushed in a mortar and heated before the casting.

TECHNICAL PROBLEM

The previously known methods of producing explosive charges are of course comparatively slow. Furthermore there are a number of disadvantages involved in these methods, such as insufficient density of the explosive material, an insufficient amount of the high-explosive component of the explosive charge, for instance the octogen or hexogen component, and bubbles and other cavities in the cast charges which have reduced the destructive effect of the charge.

The recent requirements of high-efficient ammunition can not be fulfilled by the previously known methods or devices. Furthermore it is necessary to improve the safety of the methods of producing the explosive charges.

SUMMARY OF THE INVENTION

It is a main object of our invention to provide a new method as well as a new device for cast-loading of explosive charges in which these disadvantages can be overcome.

According to the invention the method comprises the following steps: inserting a plurality of moulds or shell bodies into a unit or storage room which can be closed, preheating the moulds or shell bodies to a predetermined temperature which substantially corresponds to the melting temperature of the liquid component of the used explosive charge composition, filling the moulds or shell bodies with the explosive charge composition during which period said predetermined temperature is substantially maintained, vibrating the filled moulds or shell bodies with a predetermined frequency whereby heavier particles of the explosive charge composition sink to the bottom parts of the respective moulds or shell bodies, and after a predetermined time period for sedimentation, the moulds or shell bodies with their contents of vibrated explosive charge composition are cooled to a predetermined low temperature for solidification of the cast charges.

According to the invention the new device comprises a unit or storage room which can be closed and which comprises means for storing a plurality of moulds or shell bodies for the explosive charge composition, heating means for preheating the moulds or shell bodies to a predetermined temperature which substantially corresponds to the melting temperature of the liquid component of the used explosive charge composition, means for imparting a vibrating movement of a predetermined frequency to the moulds or shell bodies which means are arranged to be activated after the moulds or shell bodies have been filled with the explosive charge composition whereby heavier particles of the explosive charge composition sink to the bottom parts of the respective moulds or shell bodies. The heating means is arranged to substantially maintain the predetermined temperature in the unit or storage room but after a prescribed time period for sedimentation, the moulds or shell bodies with their contents of vibrated explosive charge composition are arranged to be cooled to a predetermined low temperature for solidification of the cast charges.

In the following a more specific embodiment of the invention will be described which allows an efficient but technically simple production of explosive charges and by means of which also the efficiency of the cast charges is significantly improved.

In addition to a comparatively large number of charges, for instance a number of approximately fifty charges, which can be produced at the same time, a higher density of the charges is obtained which means that by the technique the efficiency of the charges is increased by at least 10 percent. By means of the careful temperature control, the control of the entire process can be improved, which for instance eliminates the problem of voids and other difficulties. In addition to the elimination of bubbles and other cavities, the specific gravity of each cast charge is substantially increased from the increase in the concentration of the most efficient, heavy component of the explosive charge composition.

A safer production is obtained which can be carried out in a technically simple way and at a comparatively low cost. The production is carried out as an essentially closed casting process and the vibration of the explosive charge composition can be carried out safely in a room without accidental explosion.

BRIEF DESCRIPTION OF DRAWINGS

A preferred embodiment of the invention will be described more in detail with reference to the accompanying drawings in which.

DESCRIPTION OF A PREFERRED EMBODIMENT

Figures 1A, 1B, 1C, 1D:
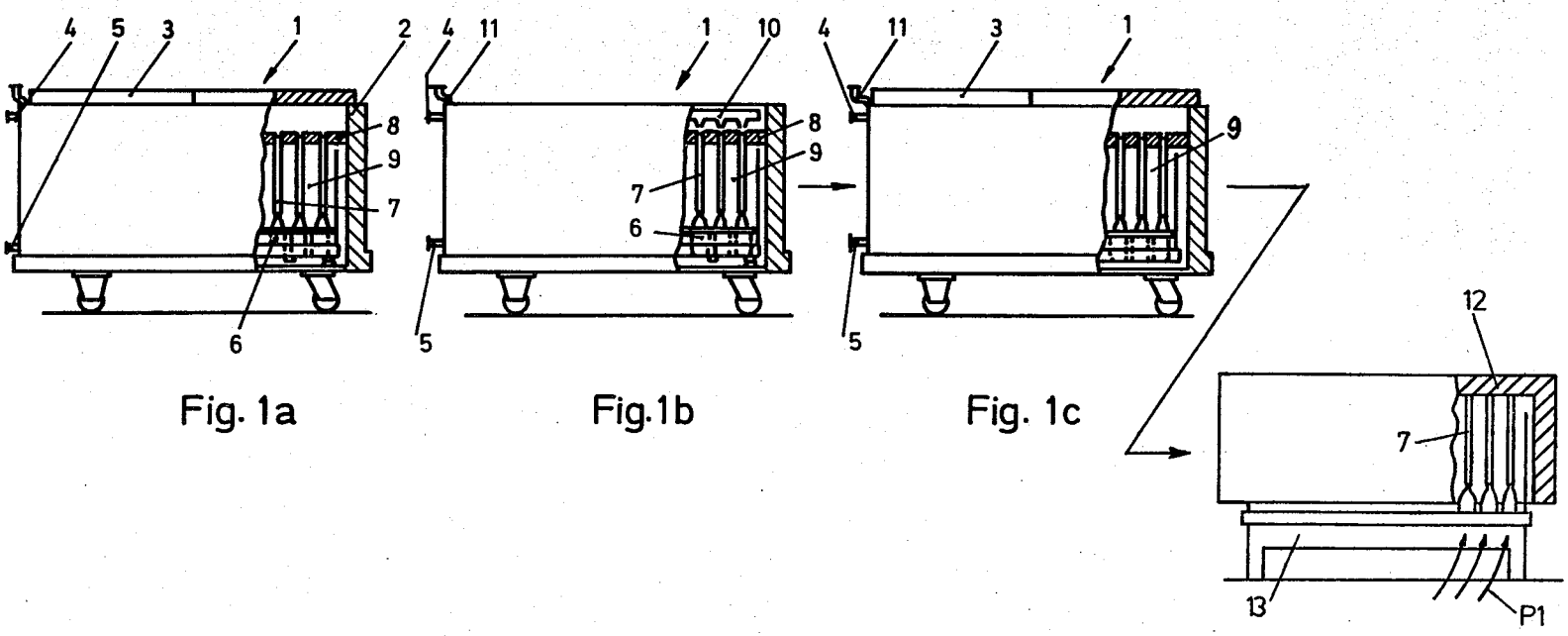
FIGS. 1*a*–1*d* show the different steps of the new casting technique.

A preferred method according to the invention is illustrated in FIGS. 1*a*–1*d*. In this case a movable unit 1 in the form of a transportable carriage is used for cast-loading of a plurality of charges, for instance 40–60. The unit, which will be described in detail, comprises a double-walled box with walls 2 and an isolated cover 3. The walls 2 comprise loops for a circulating fluid, for instance water, fed into the loops via an input connection 4 and out from the loops via an output connection 5. A mould 6 is provided for each charge and an explosive charge composition in liquid condition which consists of two or more explosive components arranged to be fed to each of the moulds via a filler tube 7. Instead of separate moulds, the cast loading may also be carried out directly in the shell bodies. This means that in the following the word "mould" also incorporates the case in which the shell bodies themselves are used as moulds. The moulds 6 and the filler tubes 7 are fixed to each other, see below. The upper parts of the filler tubes are extended through an isolated inner cover 8.

By means of the circulating water which is heated and kept at a predetermined temperature the moulds inside the closed space 9 of the carriage 1 are preheated. The control equipment for the water does not form part of our invention and is therefore not disclosed in the FIGS. 1*a*–1*d*.

After the preheating period the carriage is transported to a station for filling the moulds with the explosive charge composition in liquid condition. According to FIG. 1*b* the cover 3 of the carriage is removed at this station. The filling may be carried out by means of a funnel or tundish 10, by means of which for instance three moulds can be filled at the same time. The tundish is applied from above on the inner cover 8 and connected to the ends of the filler tubes 7. The inner cover 8 prevents cooling of the space 9 to the temperature of the local air. The carriage 1 may be transported to the filling station with the connections 4 and 5 still connected to the heating medium in question. This means that the filling of the moulds can be carried out at a carefully controlled temperature which guarantees a favourable filling function.

After filling the carriage 1 is transported to a station for vibrating the moulds which are located in the closed space 9. As the vibrating procedure in this case is carried out at a location which is separated from the filling station and which location furthermore is arranged to be safe against accidental explosion, the connections 4 and 5 are disconnected. The energy storing capacity of the used circulating medium is utilized however, so that the predetermined temperature is substantially maintained during the transport of the carriage to the station for vibrating the moulds. Before transport the carriage is closed by its cover 3. After the transport to the station for vibrating the moulds connections 4 and 5 can be reconnected to circulating and control means of the used heating medium. For vibrating the filled moulds vibrating means in the form of ball vibrators are used which ball vibrators are installed on the carriage, see below. The ball vibrators are controlled by means of compressed air and the carriage is therefore provided with a compressed air input connection line 11. During the filling and vibrating procedure, as well as during the transport of the carriage between the stations, only comparatively small changes of the temperature of the closed space 9 are allowed, for instance 0°–40° C. and preferably 0.5°–2° C. During the vibrating procedure the moulds are imparted a vibrating movement of one or more specific frequencies, which frequency or frequencies relates to the mass of the specific charge, mould etc. The vibrating procedure is maintained for a predetermined time period which depends on the type of charge.

In the present invention case cast loading is intended to be carried out by means of explosive charge compositions which include components such as octogen and trotyl or hexogen and trotyl.

The predetermined temperature must exceed the melting point of trotyl. As the melting point of trotyl amounts to approximately 80° C., the predetermined temperature preferably amounts to approximately 90° C. to 95° C. The octogen and hexogen component, respectively, is included in the explosive charge composition as solid, heavy particles which during the vibrating procedure are sedimented down to the lower parts of the moulds. The filler tubes 7 are included in the total filling volume for the explosive charge composition which means that the light trotyl component is concentrated at the upper parts of the charge and in the filler tube, but the lower parts of the mould have a comparatively high concentration of the octogen component. The trotyl is used as a binding agent for the sedimented octogen component which is a specific example amounts to 85 percentage by weight. This means that the specific gravity of the vibrated charge is increased considerably and approaches 1.81 as for the octogen itself.

After vibration and a prescribed sedimentation time period the moulds with its filler tubes are taken away for cooling to a predetermined low temperature, for instance the local temperature. For a controlled and efficient cooling of the moulds they are disposed on a specific unit on which cooled air is streamed from below for cooling the moulds. To prevent coooling from above a casing 12 according to FIG. 1*d* is used and which is made of an isolating material and disposed on the upper, free ends of the filler tubes. The specific unit for disposing the moulds is indicated by reference numeral 13 in FIG. 1*d* and provided with a grating or similar means to form passages for the streaming cooling medium, for instance air, and indicated in the figure by the arrows P1. In case that separate moulds are used, the cast charges are removed from the moulds as soon as they have solidified.

The above-mentioned equipment is reusable. Each filler tube contains a solidifed mixture which essentially contains trotyl, which can be removed from the tubes and used again for another purpose.

Figure 2:
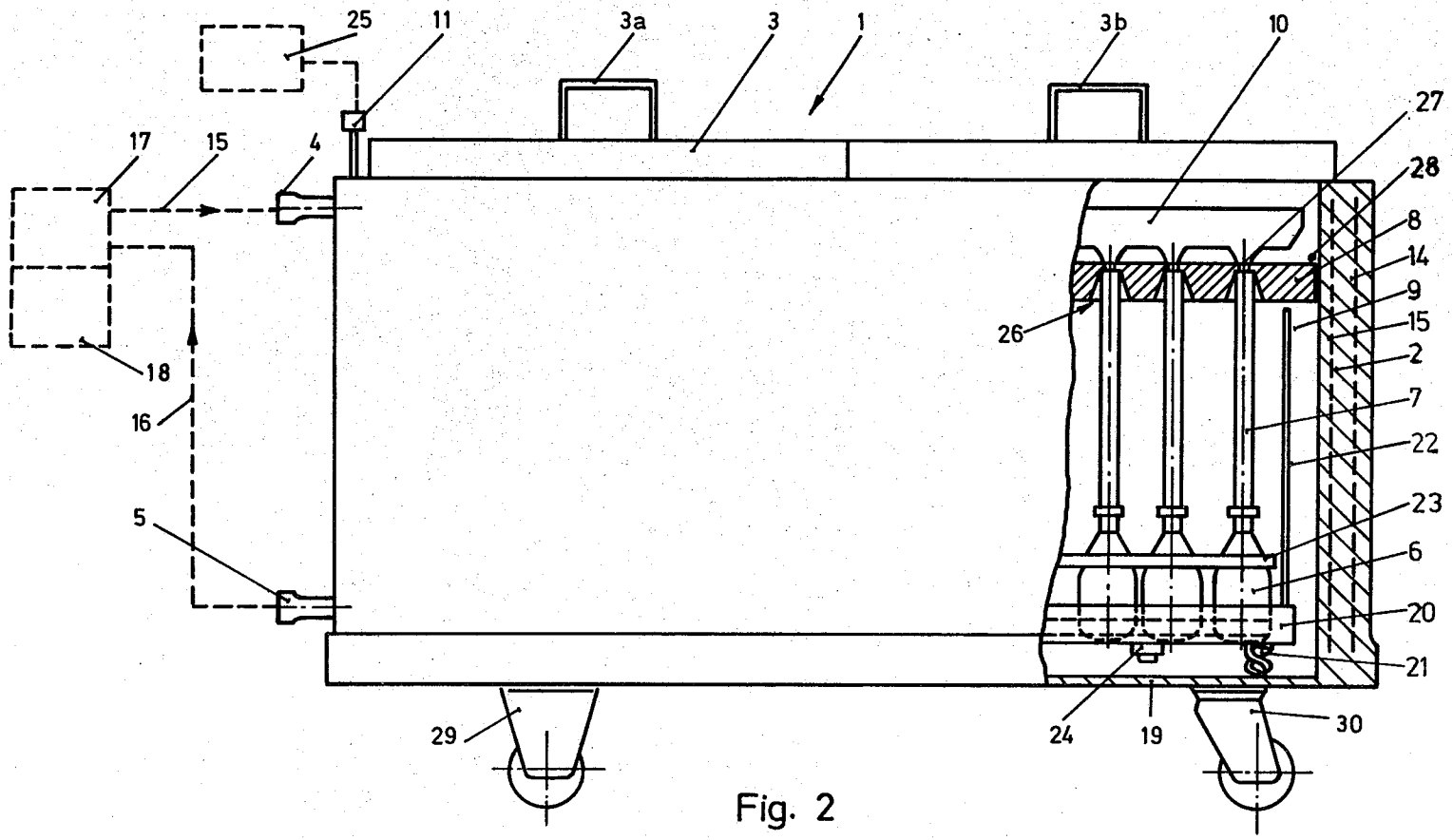
FIG. 2 is a side view, partially sectioned, of a unit for cast-loading a plurality of, fifty explosive charges.

In FIG. 2 the above-mentioned carriage 1 is illustrated more in detail. The carriage is enclosed by double walls containing termo channels 14,15 of a type called "Uddeholm". The carriage has a length of approximately 1.7 m, a height of approximately 1.0 m and a width of approximately 0.7 m and also appropriate theremochannels extending in the main parts of the walls. The thermochannels are embedded in a heat isolating material, such as cellular plastic or other corresponding material. The thermochannels are joined in a way which is known by itself and connected to the input and output connections 4 and 5, respectively. The connections comprise some type of conventional cut-off valve of for instance the bayonet coupling type. In FIG. 2 the connections 4 and 5 are connected to flexible tubes or corresponding conduits, indicated on the drawing by dashed lines. The flexible tubes are connected to a pump 17 and conventional heat controlling means 18.

Also the cover 3 is made of an isolating material such as cellular plastic or similar material. The cover comprises at least two lifting devices, 3*a* and 3*b*, and is preferably divided into two parts in order to limit any unwanted cooling during the filling of the explosive charge composition.

The carriage is further provided with a base plate 19 of steel or other corresponding strong material. Inside the carriage, upon the base plate 19, a frame member 20 is suspended on its corners by means of spring devices 21, for instance conventional screw springs. In the spring suspended frame member 20, the moulds are arranged by means of a casting rack which is provided with two lifting devices on each of its two short sides. The moulds 6 together with the filler tubes 7 and plates to secure the proper reciprocal positions of the individual moulds form a unit which can be inserted into the casting rack. On the drawing an upper securing plate 23 is indicated.

The spring-suspended frame member 20 is provided with four ball vibrators 24, for instance of the "Webac UCV-19"-type, which are sold on the open market. The ball vibrators are controlled by compressed air and are connected to a source 25 for compressed air by means of the above-mentioned compressed air connection line 11. The design of the individual compressed air connection lines on the movable unit is known per se and not illustrated here. The fixed part of each ball vibrator is attached to the spring suspended frame member 20. This means that when the ball vibrators are activated vibrating movements of specific frequencies are imparted on the frame member 20 as well as on the casting rack and the unit inserted in the casing rack. The frequency or frequencies of the vibrating movements are controlled by means of the compressed air input and depends on the specific application. In order to prevent an unwanted cooling of the closed space 9 inside the carriage the compressed air from each ball vibrator is directed to the outside of the carriage in a way which is known by itself.

The inner cover 8 also consists of an isolating material for instance cellular plastic or a similar material. As illustrated in FIG. 2 the filler tubes are extended with their free ends essentially through holes 26 in the inner cover so that they are within reach for filling by means of the tundish 10.

Holes 26 made in the inner cover 8 are conic in order to facilitate the application of the cover upon the filling tubes and the diameter of the upper portion 27 of the holes is a little less than the outer diameter of the filling tubes so that the inner cover 8 is resting upon the end surfaces of the filling tubes. The inner cover is also provided with a rubber sealing 28 for closure against the walls 2 of the carriage.

The carriage is provided with a number of wheels 29, 30, three in the present embodiment, arranged on the under side of the carriage. The wheel 30 is a free, pivotable steering wheel but the other two wheels are fixed mounted in on e direction only.

Figure 3:
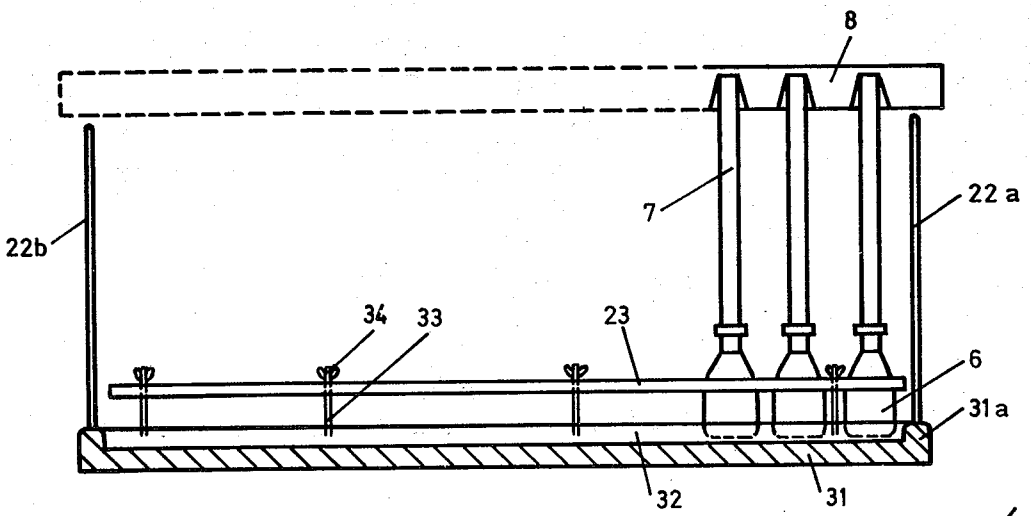
FIG. 3 is also a side view according to FIG. 2 which shows a casting rack with an insert unit for the moulds or shell bodies.

In FIG. 3 the casting rack 31 is illustrated. A protruding edge 31*a* is arranged all about the rack, on which edge the lifting devices 22*a* and 22*b* are arranged on the short sides of the rack. In addition to said upper securing plate 23 the unit inserted in the rack also comprises an inner securing plate or base plate 32.

Figure 4:
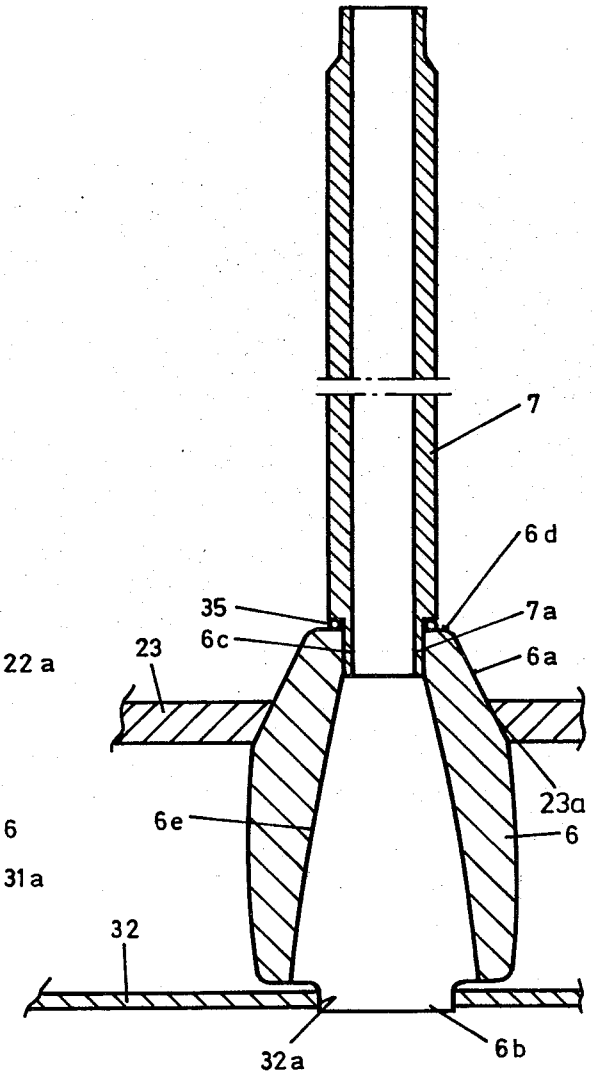
FIG. 4 shows in section a separate mould or shell body for the explosive charge composition and which is connected to a filler tube for the explosive charge composition.

The securing plates 23 and 32 are mutually connected by bolts 33 and corresponding wing nuts 34 or other corresponding nuts. As illustrated in FIG. 4 the upper securing plate 23 is cooperating with a conic upper surface of the mould 6; the upper securing plate 23 having a cone-shaped surface 23*a* corresponding to the conic surface 6*a* of the mould so that the securing plate is resting against the mould. The lower part of the mould is provided with a central part 6*b* which can be extended into a corresponding recess 32*a* in the lower securing plate or base plate 32. The upper part of the mould is provided with a central opening 6*c* adapted to a neck portion 7*a* of the corresponding filler tube 7. At the neck portion the filler tube is provided with a tightening member 35, for instance an O-ring made of rubber or a corresponding material and against which the end surface 6*d* is pressed. The inner space 6*e* of the mould is made symmetrical with respect to rotation.

By the arrangement the moulds 6 and their corresponding filler tubes and securing plates 23 and 32 form an insert unit which is fastened to the casting rack by means of the bolts 33 and its corresponding wing nuts 34. This means that the casting rack together with the insert unit forms a common unit for inserting in the frame member 20 of the carriage (see FIG. 2). The ball vibrators actuate the frame member 20, the casting rack and the insert unit for a movement in the direction opposite the paper plane of FIG. 3, so that the moulds are actuated by vibrating movements.

After cooling of the moulds according to FIG. 1*d* the securing plates 23 and 32 are removed and the moulds separated from the filler tubes 7.

The invention is not limited to the disclosed embodiments but can be modified within the scope of the accompanying claims. Instead of water as a heating medium steam could be used but then the unit must be provided with automatic ventilation. As a further alternative electrical energy could be used for heating and then the heat is stored by means of the heating elements by means of which a continuous heating is maintained. As a basic material for the above explosive charge composition octol may be used with the mixing ratio 70/30. Due to the insufficient viscosity of octol for instance 5% trotyl can be added. Despite the high percentage by volume of trotyl in the cast charges it is possible to obtain charges with as much as 85 percentage by weight of octogen. Of course also other explosive components may be used in the charge composition.

INDUSTRIAL APPLICABILITY

The proposed device according to the invention can be easily produced by any manufacturing industry and can be easily applied for manufacturing explosive charge compositions, for instance shaped charges, in an economical and technically simple way.

We claim:

1. A method for cast loading an explosive charge composition of the type including liquid and solid sedimentary components comprising:

vertically positioning a plurality of shell bodies within a wheel supported enclosure for receiving said explosive charge composition;

preheating the interior of said enclosure with heating channels within said enclosure to maintain said shell bodies at a pre-established temperature for maintaining said charge composition in a liquid state;

filling said plurality of shell bodies with said charge composition of liquid and solid components while maintaining said shell bodies at said predetermined temperature;

vibrating said filled shell bodies at a predetermined frequency while maintaining said predetermined temperature whereby heavy particles of said explosive charge composition sink to the lower portions of said shell bodies; and moving said enclosure to a cooling station and thence cooling said shell bodies until said composition assumes a solid state.

2. The method according to claim 1, wherein each of said shell bodies is filled by filling tube means, and said predetermined temperature is maintained within said enclosure by circulating a heating liquid through channels in said walls of said enclosure, and said predetermined temperature is established by said heating liquid to exceed the melting temperature of a binding agent component of the explosive charge composition, whereby during filling and vibrating of said explosive charge composition, said explosive binding agent component is concentrated in a filling tube means and heavy explosive charge component is concentrated in said shell bodies.

3. Method according to claims 1 or 2, wherein the shell bodies after a predetermined time period to permit sedimentation of said heavy particles are removed from the enclosure and cooled from the underside by an air stream to a predetermined low temperature.

4. An apparatus for cast loading an explosive charge composition which includes a liquid as well as a solid component comprising:

a closed unit having a wheel supported base member, side walls and an outer cover, said unit including a frame member supported to said base within said walls by spring means, said side walls including heating liquid channels for preheating the interior of said closed unit to a predetermined temperature;

a rack supported to said frame for maintaining a plurality of shell bodies vertically erect for receiving said explosive charge composition;

an inner cover positioned within said closed unit;

a plurality of filling tubes extending from each of said shell bodies vertically upward towards said outer cover, each of said filling tubes terminating in one of a plurality of conically formed apertures of an inner cover;

a fill station for receiving said closed unit and maintaining a heating liquid in said channels, whereby said predetermined temperature is maintained, and further including means for filling said shell bodies with said explosive composition through said plurality of conically formed apparatus and said filling tubes;

means for vibrating said shell bodies after said explosive composition is received, whereby solid particles in said explosive composition are deposited in the bottom portion of said shell bodies; and a cooling station for receiving said closed unit and directing a flow of cooling air to the underside of said closed unit, whereby said shell bodies are cooled.

5. The apparatus of claim 4 wherein said heating channels maintain said heating liquid within a temperature of 0°–4° C., said temperature being in excess of the melting temperature of an explosive binding agent of said explosive charge composition, whereby during vibration of said shell bodies, said binding agent is concentrated in said filling tubes, and the remaining components of said explosive charge remain in said shell bodies.

6. The apparatus of claim 4 wherein said vibrating means consists of ball vibrators connected to vibrate said spring means supported frame member.

7. Apparatus according to claim 4, wherein said closed unit comprises a double walled box with thermochannels for the circulating heating liquid and an isolated outer cover, and said unit is provided with connections for the heating liquid as well as for compressed air for actuating the vibrators.

8. Apparatus according to claim 7, wherein said movable unit permits removal of the rack with the vibrated cast charges is removable after a predetermined settling time period, and said rack is disposed on a separate member and said shell bodies are cooled from below.

9. Apparatus according to claim 4, wherein said movable unit after the filling of the shell bodies is transported to a location which is safe for accidental explosion prior to vibration of said shell bodies, and during movement of the unit from the filling location to the location for the vibrating movement the heating liquid maintains the predetermined temperature.

* * * * *